US005220247A

United States Patent [19]

Moisin

[11] Patent Number: 5,220,247

[45] Date of Patent: Jun. 15, 1993

[54] CIRCUIT FOR DRIVING A GAS DISCHARGE LAMP LOAD

[76] Inventor: Mihail S. Moisin, 20 E. Marion Ave., Lake Forest, Ill. 60045

[21] Appl. No.: 860,852

[22] Filed: Mar. 31, 1992

[51] Int. Cl.[5] ..... H05B 41/29

[52] U.S. Cl. ..... 315/209 R; 315/189; 315/210; 315/226; 315/228; 315/239; 315/DIG. 5

[58] Field of Search ..... 315/186, 187, 189, 200 R, 315/210, 226, 227 R, 228, 239, DIG. 2, DIG. 5, DIG. 7

[56] References Cited

U.S. PATENT DOCUMENTS 4,525,649 6/1985 Knoll et al. ..... 315/189 X
4,525,650 6/1985 Hicks et al. ..... 315/239 X
5,138,234 8/1992 Moisin ..... 315/209 R

*Primary Examiner*—Davis Mis

[57] ABSTRACT

For driving gas discharge lamps (102, 104) having heatable filaments (102A, 102B, 104A, 104B), a circuit (100) has an inverter (132, 134) and a series-resonant LC oscillator (150, 158, 170) forming a self-oscillating inverter. The oscillator output provides filament-heating current through the filaments in series, and drives arc current serially through the lamps. A feedback transformer (174) with a winding (172) connected serially in the filament-heating current path controls the operation of the inverter. A voltage clamp (180, 182) limits the voltage applied to the lamps. The circuit does not require an output-coupling transformer to couple the output of the self-oscillating inverter to lamps, thus avoiding the added cost that the use of such a transformer would bring, while providing efficient, substantially fixed frequency operation of a wide variety of lamp loads, together with the ability to address a number of lamp fault modes. Alternatively, the lamps may be driven in parallel.

20 Claims, 2 Drawing Sheets

CIRCUIT FOR DRIVING A GAS DISCHARGE LAMP LOAD

BACKGROUND OF THE INVENTION

This invention relates to circuits for driving gas discharge lamps, and particularly, though not exclusively, to circuits for driving fluorescent lamps.

In a typical prior art circuit for driving a plurality of fluorescent lamps, the lamps are driven from a high-frequency resonant circuit powered from a DC power source via an inverter. The lamps are typically coupled to the output of the resonant circuit via a transformer, and filaments of the lamps are provided with heating current from small individual windings on an output-coupling transformer.

Such prior art circuits typically offer low operating efficiencies. Also, the use of an output-coupling transformer adds to the cost of the circuit.

SUMMARY OF THE INVENTION

In accordance with the invention there is provided a circuit for driving a gas discharge lamp load having heatable filaments, the circuit comprising:

input terminals for connection to a source of voltage supply;

output terminals for connection to the filaments of the gas discharge lamp load;

inverter means coupled to the input terminals and having an output;

series-resonant LC oscillator means coupled to the inverter means output for producing a high-frequency output voltage for application to the gas discharge lamp load;

feedback means having an input for connection in series with at least one of the heatable filaments of the gas discharge lamp load, and having an output connected to control the inverter means; and voltage limiting means for connection to the gas discharge lamp load and coupled to the inverter means to limit voltage at the gas discharge lamp load.

It will be understood that such a circuit allows efficient operation, and does not require the use of an output-coupling transformer, allowing the circuit's cost to be reduced. In a preferred embodiment, such a circuit can cope simply and effectively with a number of fault modes which may arise in the driven load.

BRIEF DESCRIPTION OF THE DRAWINGS

Two fluorescent lamp driver in accordance with the present invention will now be described, by way of example only, with reference to the accompanying drawings, in which.

DESCRIPTION OF THE PREFERRED EMBODIMENT

Figure 1:
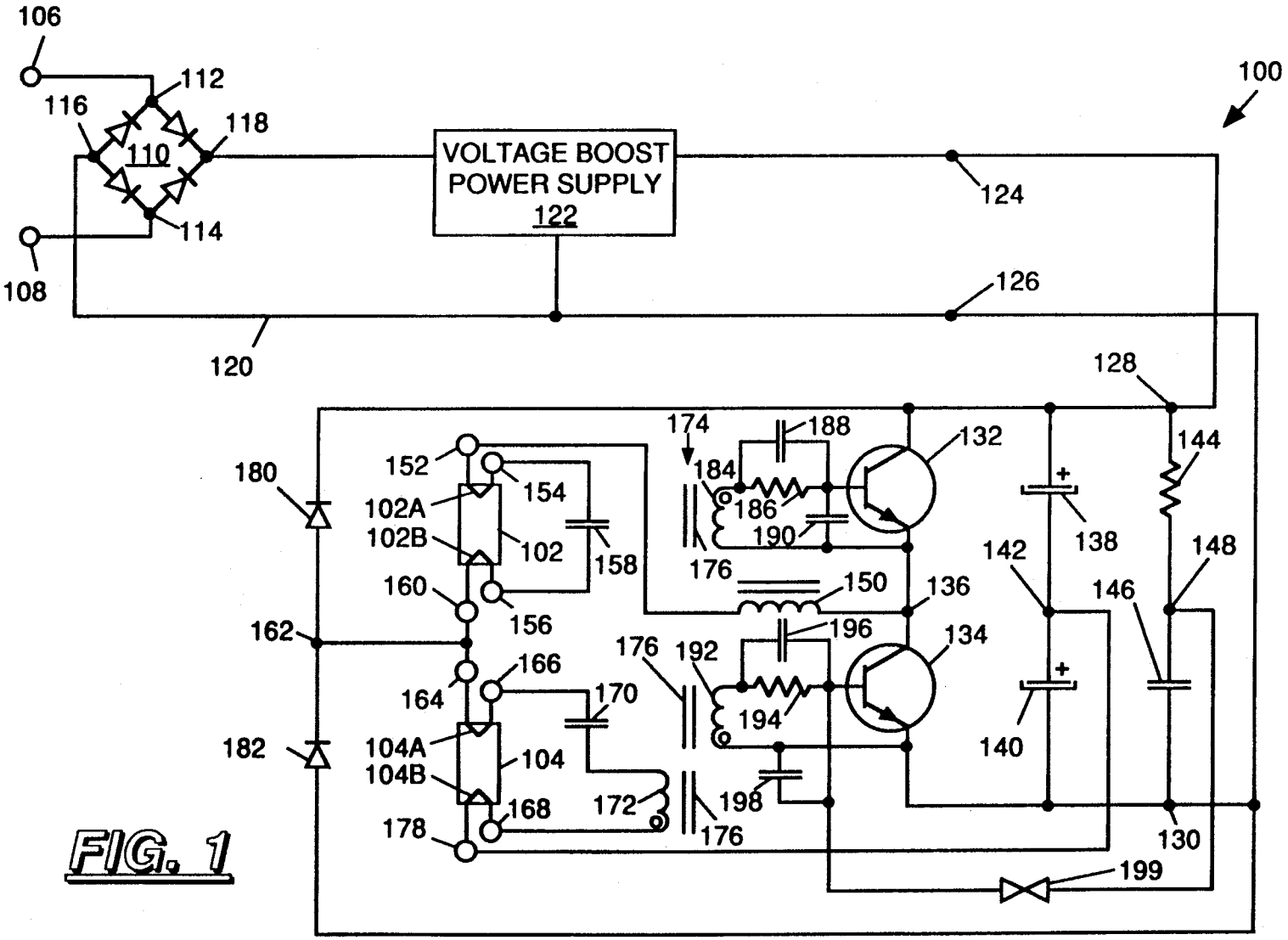
FIG. 1 shows a schematic circuit diagram of a driver circuit for driving two fluorescent lamps in series.

Referring now to FIG. 1, a circuit 100, for driving two fluorescent lamps 102, 104 has two input terminals 106, 108 for receiving thereacross an AC supply voltage of approximately 240 V at a frequency of 50 Hz. A fullwave rectifying bridge circuit 110 has two input nodes 112, 114 connected respectively to the input terminals 106, 108, and has two output nodes 116, 118. The output node 116 of the bridge 110 is connected to a ground voltage rail 120.

A voltage boost power supply 122 (the typical detailed construction of which is well-known to a person skilled in the art) is connected to the output nodes 116 and 118 of the bridge circuit 110. The voltage boost power supply 122 is configured to produce in use a boosted voltage DC voltage of approximately 450 V between power supply output nodes 124 and 126.

The power supply output nodes 124 and 126 are connected to input nodes 128 and 130 of a half-bridge inverter formed by two npn bipolar transistor 132 and 134 (each of the type MJE18004). The transistor 132 has its collected electrode connected to the input node 128, and has its emitter electrode connected to an output node 136 of the inverter. The transistor 134 has its collected electrode connected to the node 136, and has its emitter electrode connected to the input node 130. Two electrolytic capacitors 138 and 140 (each having a value of approximately 47 $\mu$F) are connected in series between the inverter input nodes 128 and 130 via an intermediate node 142. For reasons which will be explained below, a resistor 144 (having a value of approximately 1M$\Omega$) and a capacitor 146 (having a value of approximately 0.1 $\mu$F) are connected in series between the inverter input nodes 128 and 130 via an intermediate node 148.

The inverter output node 136 is connected, via a cored inductor 150 (having a value of approximately 2.7 mH), to a terminal 152 of the fluorescent lamp 102. Terminals 154 and 156 of the fluorescent lamp 102 are connected via a capacitor 158 (having a value of approximately 15 nF). A terminal 160 of the fluorescent lamp 102 is connected to a node 162.

The node 162 is connected to a terminal 164 of the fluorescent lamp 104. Terminals 166 and 168 of the fluorescent lamp 104 are connected via a capacitor 170 (having a value of approximately 15 nF) and a primary winding 172 of a transformer 174. The transformer 174 is wound on a core 176, and the primary winding 172 is formed by approximately ten turns of winding wire. A terminal 178 of the fluorescent lamp 102 is connected to the node 142 intermediate the capacitors 138 and 140.

The node 162 intermediate the lamp terminals 160 and 164 is connected to the boost power supply output node 124 via a diode 180 (of the type IN4932), whose anode is connected to the node 162 and whose cathode is connected to the node 124. The intermediate node 162 is also connected to the boost power supply output node 126 via a diode 182 (also of the type IN4932), whose cathode is connected to the node 162 and whose anode is connected to the node 126.

A secondary winding 184 (formed by approximately thirty turns of winding wire on the core 176) of the transformer 174 is coupled between the base and emitter electrodes of the transistor 132. A resistor 186 (having a value of approximately 27$\Omega$)is connected in series between the secondary winding 184 and the base electrode of the transistor 132. A capacitor 188 (having a value of approximately 0.15 $\mu$F) is connected in parallel with the resistor 186. A capacitor 190 (having a value of approximately 0.1 $\mu$F) is connected between the base and emitter electrodes of the transistor 132.

A further secondary winding 192 (formed by approximately thirty turns of winding wire on the core 176) of the transformer 174 is coupled between the base and emitter electrodes of the transistor 134. A resistor 194 (having a value of approximately 27$\Omega$) is connected in series between the secondary winding 192 and the base electrode of the transistor 134. A capacitor 196 (having a value of approximately 0.15 μF) is connected in parallel with the resistor 194. A capacitor 198 (having a value of approximately 0.1 μF) is connected between the base and emitter electrodes of the transistor 134.

The secondary windings 184 and 192 are connected with opposite polarities between the base and emitter electrodes of the inverter transistors 132 and 134 respectively. For reasons which will be explained below, the base electrode of the transistor 134 is connected via a diac 199 (having a voltage breakdown of approximately 32 V) to the node 148.

It will be understood that in use of the circuit 100, the inductor 150 together with the capacitors 158 and 170 form a series-resonant LC circuit. It will further be understood that the transistors 132 and 134 and their associated components, together with this series-resonant LC circuit, forms a self-oscillating inverter which powers the fluorescent lamps 102 and 104. As will be explained further below, in the preferred embodiment component values are chosen so that the self-oscillating inverter oscillates with a substantially constant frequency of approximately 40 KHz.

In operation of the circuit of FIG. 1, with a voltage of 240 V, 50 Hz applied across the input terminals 106 and 108, the bridge 110 produces between the node 120 and the ground voltage rail 120 a unipolar, full-wave rectified, DC voltage having a frequency of 100 Hz.

When the circuit is first powered-up, activation of the voltage boost power supply 122 is delayed for a period of approximately 0.7 seconds, during which the DC voltage produced between the output nodes 124 and 126 is un-boosted and is not sufficiently high to cause the fluorescent lamps 102 and 104 to strike. During this delay period, the un-boosted voltage between the output nodes 124 and 126 causes current to begin to flow through the resistor 144 and to begin to charge the capacitor 146. The voltage across the capacitor 146 thus increases at a rate dependent on its own value and that of the resistor 144. When the voltage across the capacitor 172 reaches the breakdown value of the diac 199 (approximately 32 V) this voltage is applied through the diac to the base of the transistor 134. This applied voltage causes the transistor 134 to turn on, and sets into operation the self-oscillating inverter formed by the transistors 132 and 134, the inductor 150 and the capacitors 168 and 170. In the preferred embodiment of the circuit of FIG. 1 component values are chosen to produce a delay of approximately 40 milliseconds between initial power-up of the circuit and activation of the self-oscillating inverter.

As mentioned above, the circuit of FIG. 1 is so arranged that, with the self-oscillating inverter activated, when the un-boosted voltage appears between the output terminals 124 and 126 the voltage produced by the self-oscillating inverter is insufficient to cause the lamps to strike, but causes current to flow through the lamp filaments 102A, 102B and 104A, 104B so as to heat the filaments in preparation for striking. Thus, the path of filament heating current through the lamps is: from terminal 152 through filament 102A to terminal 154, through the capacitor 158 to terminal 156, through filament 102B to terminal 160 and thence to terminal 164, through filament 104A to terminal 166, through the capacitor 170 and the primary winding 172 to terminal 168, and through filament 104B to terminal 178.

After the delay period of approximately 0.7 seconds the voltage boost power supply is activated and the voltage produced between the output nodes 124 and 126 rises to its boosted value of approximately 450 V. This boosted voltage causes the self-oscillating inverter to produce sufficient voltage between the terminals 152 and 178 to cause the lamps 102 and 104 to strike. With the lamps struck, filament heating current continues to flow as described above and powers the self-oscillating inverter by feedback through the transformer 174.

Thus, the fluorescent lamps 102 and 104 are started optimally by having their filaments adequately preheated before being presented with a high voltage to cause them quickly to strike.

It will be understood that the diodes 180 and 182, which respectively connect the power supply nodes 124 and 126 to the node 162 between the lamps 102 and 104, serve as a voltage clamp which limits the voltage applied across the lamps (and thus limits the energy supplied to the lamps) to a predetermined desired maximum value. When the voltage at the node 162 increases above the voltage at the inverter input node 128, the diode 180 becomes forward biased, causing the excess voltage at the node 162 to charge the capacitor 138. Similarly, when the voltage at the center-tap node 162 falls below the voltage at the inverter input node 130, the diode 182 becomes forward biased, causing the excess voltage at the node 162 to charge the capacitor 140. As the capacitors 138 and 140 charge from the diodes 180 and 182, they supply the energy to power the self-oscillating inverter, and cause less power to be drawn from supply connected across the input terminals 106 and 108.

As mentioned above, the self-oscillating inverter of the circuit of FIG. 1 operates at a substantially constant frequency. It will be understood that this allows the transformer 174 to be optimized for efficient, non-saturating (i.e., linear) operation at this frequency. It will also be understood that this allows the inverter transistors to be operated switching at near-zero current with reduced risk of cross-conduction (which would destroy the transistors), producing less heating in the transistors and so allowing the transistors to be smaller and cheaper.

It will be understood that the arrangement of a series-resonant LC, self-oscillating inverter driving fluorescent lamps as shown in the circuit of FIG. 1 exhibits increased efficiency and allows the circuit to drive a wide variety of loads. In the preferred embodiment described, the circuit was designed to drive lamps 102 and 104 of 60 W capacity; however, the circuit can also drive lamp loads as low as 20 W capacity with little or no change in efficiency.

Further, it will be understood that the circuit 100 is able, simply and effectively, to address a number of fault modes:

Shorted Load: If the lamp 102 becomes shorted between it ends, the circuit continues to drive the lamp 104 and the voltage clamp diodes 180 and 182 prevent the energy supplied to the lamp 104 from exceeding a desired maximum value.

Shorted Filament: If either of the lamps experiences a shorted filament (which would prevent the lamp from sustaining a discharge), current will still flow between the lamp terminals 152 and 178 and the non-faulted lamp will continue to be driven, with the voltage clamp diodes 180 and 182 preventing the energy supplied to the driven lamp from exceeding a desired maximum value.

Non-Striking Lamp: If either of the lamps fails or ceases to strike (e.g., if the gas conditions within the lamp become insufficient to support an arc) then, provided that the lamp filaments continue to conduct, current will still flow between the lamp terminals 152 and 178 and the non-faulted lamp will continue to be driven, with the voltage clamp diodes 180 and 182 preventing the energy supplied to the driven lamp from exceeding a desired maximum value If, however, the lamp 104 is removed, or for any other reason current ceases to flow in the primary winding 172, feedback to the inverter transistors becomes absent, and the self-oscillating inverter immediately ceases oscillation and renders the circuit inoperative.

Figure 2:
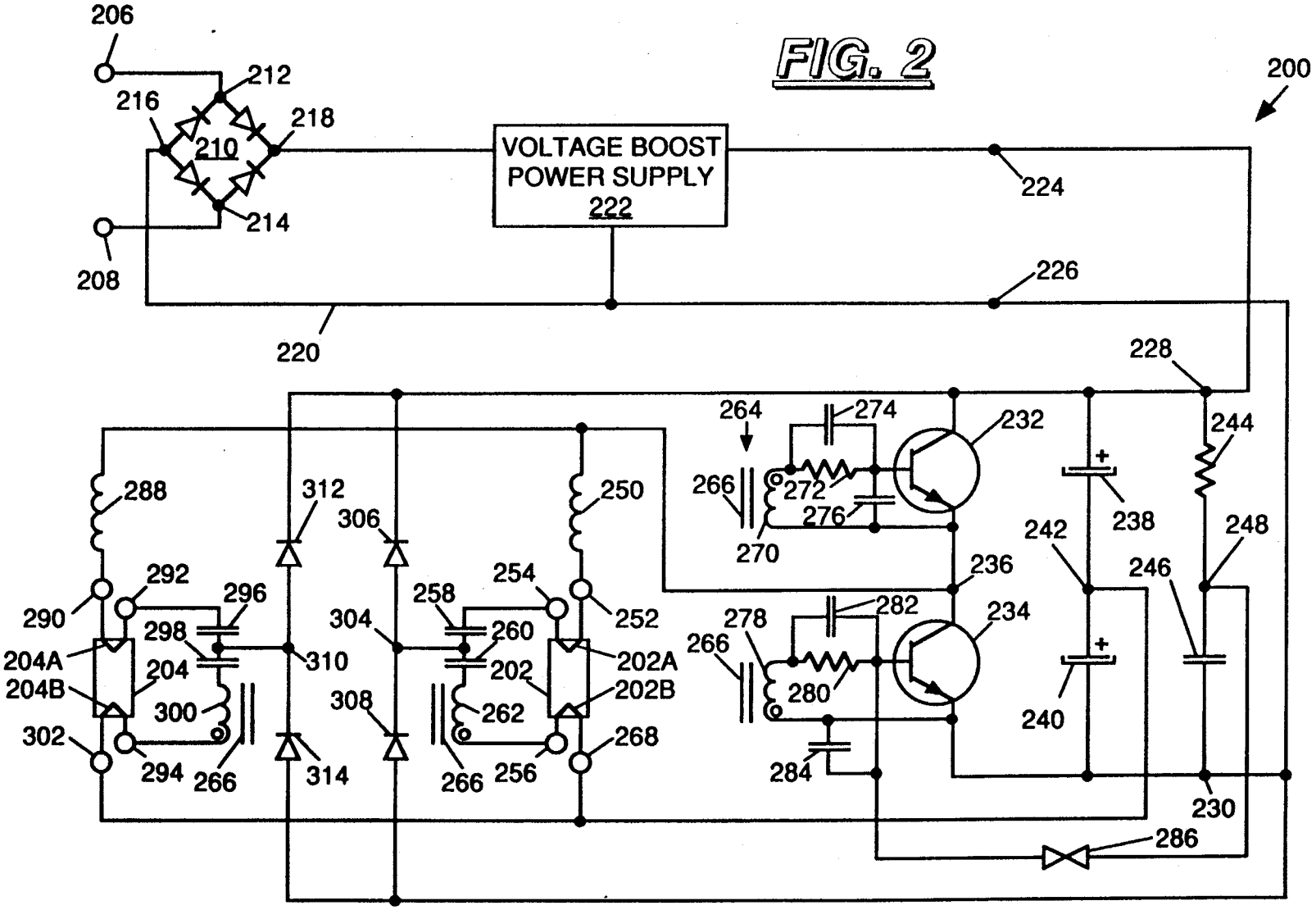
FIG. 2 shows a schematic circuit diagram of a driver circuit for driving two fluorescent lamps in parallel.

Referring now to FIG. 2, a circuit 200, for driving two fluorescent lamps 202, 204 has two input terminals 206, 208 for receiving thereacross an AC supply voltage of approximately 240 V at a frequency of 50 Hz. A fullwave rectifying bridge circuit 210 has two input nodes 212, 214 connected respectively to the input terminals 206, 208, and has two output nodes 216, 218. The output node 216 of the bridge 210 is connected to a ground voltage rail 220.

A voltage boost power supply 222 (the typical detailed construction of which is well-known to a person skilled in the art) is connected to the output nodes 216 and 218 of the bridge circuit 210. The voltage boost power supply 222 is configured to produce in use a boosted voltage DC voltage of approximately 350 V between power supply output nodes 224 and 226.

The power supply output nodes 224 and 226 are connected to input nodes 228 and 230 of a half-bridge inverter formed by two npn bipolar transistor 232 and 234 (each of the type BUL146). The transistor 232 has its collector electrode connected to the input node 228, and has its emitter electrode connected to an output node 236 of the inverter. The transistor 234 has its collector electrode connected to the node 236, and has its emitter electrode connected to the input node 230. Two electrolytic capacitors 238 and 240 (each having a value of approximately 47 μF) are connected in series between the inverter input nodes 228 and 230 via an intermediate node 242. For reasons which will be explained below, a resistor 244 (having a value of approximately 1MΩ) and a capacitor 246 (having a value of approximately 0.1 μF) are connected in series between the inverter input nodes 228 and 230 via an intermediate node 248.

The inverter output node 236 is connected, via an inductor 250 (having a value of approximately 2.1 mH), to a terminal 252 of the fluorescent lamp 202. Terminals 254 and 256 of the fluorescent lamp 202 are connected via a capacitor 258 (having a value of approximately 22 nF), a capacitor 260 (having a value of approximately 18 nF) and a primary winding 262 of a transformer 264. The transformer 264 is wound on a core 266, and the primary winding 262 is formed by approximately ten turns of winding wire. The capacitor 258, the capacitor 260 and the primary winding 262 are connected in series between the lamp terminals 254 and 256. A terminal 268 of the fluorescent lamp 202 is connected to the node 242 intermediate the capacitors 238 and 240.

A secondary winding 270 (formed by approximately thirty turns of winding wire on the core 266) of the transformer 264 is coupled between the base and emitter electrodes of the transistor 232. A resistor 272 (having a value of approximately 27Ω) is connected in series between the secondary winding 270 and the base electrode of the transistor 232. A capacitor 274 (having a value of approximately 0.15 μF) is connected in parallel with the resistor 272. A capacitor 276 (having a value of approximately 0.1 μF) is connected between the base and emitter electrodes of the transistor 232.

A further secondary winding 278 (formed by approximately thirty turns of winding wire on the core 176) of the transformer 264 is coupled between the base and emitter electrodes of the transistor 234. A resistor 280 (having a value of approximately 27Ω) is connected in series between the secondary winding 278 and the base electrode of the transistor 234. A capacitor 282 (having a value of approximately 0.15 μF) is connected in parallel with the resistor 280. A capacitor 284 (having a value of approximately 0.1 μF) is connected between the base and emitter electrodes of the transistor 234.

The secondary windings 270 and 278 are connected with opposite polarities between the base and emitter electrodes of the inverter transistors 232 and 234 respectively. The base electrode of the transistor 234 is connected via a diac 286 (having a voltage breakdown of approximately 32 V) to the node 248.

The inverter output node 236 is also connected, via an inductor 288 (having a value of approximately 2.1 mH), to a terminal 290 of the fluorescent lamp 204. Terminals 292 and 294 of the fluorescent lamp 204 are connected via a capacitor 296 (having a value of approximately 22 nF), a capacitor 298 (having a value of approximately 18 nF) and a further primary winding 300 (formed by approximately ten turns of winding wire on the core 266) of the transformer 264. The capacitor 296, the capacitor 298 and the primary winding 300 are connected in series between the lamp terminals 292 and 294. A terminal 302 of the fluorescent lamp 204 is connected to the node 242 intermediate the capacitors 238 and 240.

A node 304 intermediate the capacitors 258 and 260 (coupled to the lamp 202) is connected to the boost power supply output node 224 via a diode 306 (of the type IN4937), whose anode is connected to the node 304 and whose cathode is connected to the node 224. The intermediate node 304 is also connected to the boost power supply output node 226 via a diode 308 (also of the type IN4937), whose cathode is connected to the node 304 and whose anode is connected to the node 226.

A node 310 intermediate the capacitors 296 and 298 (coupled to the lamp 204) is connected to the boost power supply output node 224 via a diode 312 (of the type IN4937), whose anode is connected to the node 310 and whose cathode is connected to the node 224. The intermediate node 310 is also connected to the boost power supply output node 226 via a diode 314 (also of the type IN4937), whose cathode is connected to the node 310 and whose anode is connected to the node 226.

It will be appreciated that in use the circuit 200 operates in a fundamentally similar manner to the above described circuit 100 of FIG. 1, the essential difference between the two circuits being that in the circuit of FIG. 1 the lamps 102 and 104 are driven in series from a single series-resonant LC oscillator fed from an inverter, whereas in the circuit of FIG. 2 the lamps 202 and 204 are driven in parallel from respective series-resonant LC oscillators fed from a single inverter. In each circuit, it will be appreciated that the lamps are driven from a series-resonant LC, self-oscillating inverter which is controlled by feedback from lamp filament current and that the voltage applied to the lamps is limited to a desired maximum value.

Thus, in the circuit 200 of FIG. 2, the lamp 202 is driven by the series-resonant LC oscillator formed by the inductor 250 and the capacitors 258 and 260, this LC oscillator being fed from the inverter (formed by the transistors 232 and 234 and their associated components) which is controlled via the transformer 264 by feedback from the filament current of both the lamp 202 and the lamp 204. The voltage applied to the lamp 202 is sensed at node 304 and is limited by the diodes 306 and 308 which act as a voltage clamp in the same manner as described above in relation to the circuit 100 of FIG. 1.

Similarly, the lamp 204 is driven by the series-resonant LC oscillator formed by the inductor 288 and the capacitors 296 and 298, this LC oscillator being fed from the inverter (formed by the transistors 232 and 234 and their associated components) which is controlled via the transformer 264 by feedback from the filament current of both the lamp 202 and the lamp 204. The voltage applied to the lamp 204 is sensed at node 310 and is limited by the diodes 312 and 314 which act as a voltage clamp in the same manner as described above.

It will be appreciated that when first powered-up, the circuit 200 of FIG. 2 acts in exactly the same way as the above described circuit 100 of FIG. 1, with activation of the voltage boost power supply 122 being delayed for a period of approximately 0.7 seconds. During this period the voltage produced by the series-resonant LC oscillators is insufficient to cause the lamps to strike but sufficient to cause an adequate level of filament heating current to flow respectively in series through the filaments 202A, 202B, 204A and 204B of the lamps and the primary windings 262 and 300. After this delay period the voltage boost power supply is activated and the voltage produced between the output nodes 224 and 226 rises to its boosted value of approximately 350 V. This boosted voltage causes the series-resonant LC oscillators to produce sufficient voltage to cause the lamps 202 and 204 to strike. With the lamps struck, filament heating current continues to flow as described above and powers the self-oscillating inverter by feedback through the transformer 264. Thus, the fluorescent lamps 202 and 204 are started optimally by having their filaments adequately pre-heated before being presented with a high voltage to cause them quickly to strike.

It will be appreciated that, the self-oscillating inverter of the circuit of FIG. 2 (like that of FIG. 1) operates at a substantially constant frequency of approximately 40 KHz. It will be understood that this allows the transformer 264 to be optimized for efficient, non-saturating (i.e., linear) operation at this frequency. It will also be understood that this allows the inverter transistors to be operated switching at near-zero current with reduced risk of cross-conduction (which would destroy the transistors), producing less heating in the transistors and so allowing the transistors to be smaller and cheaper.

It will also be appreciated that (like the circuit of FIG. 1) the circuit of FIG. 2 exhibits increased efficiency and allows the circuit to drive a wide variety of loads.

Like the circuit 100 of FIG. 1, the circuit 200 is able simply and effectively to address a number of fault modes. However, compared with the circuit of FIG. 1, the circuit of FIG. 2 provides enhanced fault-mode performance as follows:

Shorted Load: If either lamp 202 or lamp 204 becomes shorted between it ends, the circuit continues to drive the other lamp and the voltage clamp diodes prevent the energy supplied to this lamp from exceeding a desired maximum value. Additionally, (although feedback from the transformer winding of the non-shorted lamp remains) since feedback from the transformer winding of the shorted lamp is reduced or removed, the total amount of energy fed back to the inverter is reduced, causing the inverter to feed less energy to the series-resonant LC oscillators which consequently feed less energy to the lamps. In this way the circuit of FIG. 2 operates in a self-regulating manner.

Shorted Filament: If either of the lamps experiences a shorted filament (which would prevent the lamp from sustaining a discharge), current will still flow between the lamp terminals 152 and 178 and the non-faulted lamp will continue to be driven, with the voltage clamp diodes 180 and 182 preventing the energy supplied to the driven lamp from exceeding a desired maximum value.

Non-Striking Lamp: If either of the lamps fails or ceases to strike (e.g., if the gas conditions within the lamp become insufficient to support an arc) then, provided that the lamp filaments continue to conduct, current will still flow between the lamp terminals 152 and 178 and the non-faulted lamp will continue to be driven, with the voltage clamp diodes 180 and 182 preventing the energy supplied to the driven lamp from exceeding a desired maximum value Removal of One Lamp: If either of the lamps is removed or for any other reason current ceases to flow in the transformer winding of either of the lamps, the other lamp will still continue to provide feedback energy to the inverter and so the circuit continue to drive this lamp. Additionally, since the total amount of energy fed back to the inverter is reduced, the inverter feeds less energy to the series-resonant LC oscillators which consequently feed less energy to the lamps. In this way the circuit of FIG. 2 operates in a self-regulating manner. If, however, both lamps 202 and 204 are removed, or for any other reason current ceases to flow in the transformer windings 262 and 300, feedback to the inverter transistors becomes absent, and the self-oscillating inverter immediately ceases oscillation and renders the circuit inoperative.

It will be appreciated that the both of the circuits 100 and 200 described above do not require an output-coupling transformer to couple the output of the self-oscillating inverter to lamps, thus avoiding the added cost that the use of such a transformer would bring, while providing efficient, substantially fixed frequency operation of a wide variety of lamp loads, together with the ability to address a number of lamp fault modes.

It will be appreciated that although in both FIG. 1 and FIG. 2 there have been described circuits for driving two lamps, the invention is not restricted to the driving of two lamps. It will be understood that the invention is also applicable to circuits for driving any number of lamps.

It will be appreciated that the particular component values and the particular voltage levels may be varied as desired to suit different types of fluorescent or other gas discharge lamps.

It will be appreciated that various other modifications or alternatives to the above described embodiment will be apparent to a person skilled in the art without departing from the inventive concept.

I claim:

1. A circuit for driving a gas discharge lamp load having heatable filaments, the circuit comprising:

input terminals for connection to a source of voltage supply;

output terminals for connection to the filaments of the gas discharge lamp load;

inverter means coupled to the input terminals and having an output;

series-resonant LC oscillator means coupled to the inverter means output for producing a high-frequency output voltage for application to the gas discharge lamp load;

feedback means having an input for connection in series with at least one of the heatable filaments of the gas discharge lamp load, and having an output connected to control the inverter means; and voltage limiting means for connection to the gas discharge lamp load and coupled to the inverter means to limit voltage at the gas discharge lamp load.

2. A circuit according to claim 1 wherein the series-resonant LC oscillator means comprises: an inductance for connection in series between the output of the inverter means and the gas discharge lamp load; and a capacitance for connection in series with at least one of the heatable filaments of the gas discharge lamp load.

3. A circuit according to claim 1 wherein the feedback means comprises a transformer having a primary winding for connection in series with at least one of the heatable filaments of the gas discharge lamp load, and at least one secondary winding connected the output of the feedback means.

4. A circuit according to claim 1 wherein the inverter means comprises at least one switching transistor having a base electrode coupled to the output of the feedback means.

5. A circuit according to claim 1 wherein the inverter means comprises first and second switch means and the feedback means comprises: a transformer having a primary winding for connection in series with at least one of the heatable filaments of the gas discharge lamp load; a first secondary winding coupled to control the first switch means of the inverter means; and a second secondary winding coupled to control the second switch means of the inverter means.

6. A circuit according to claim 1 wherein the voltage limiting means comprises at least one voltage clamp diode.

7. A circuit for driving first and second gas discharge lamps having heatable filaments, the circuit comprising:

input terminals for connection to a source of voltage output terminals for connection to the filaments of the gas discharge lamps;

inverter means coupled to the input terminals and having an output;

series-resonant LC oscillator means coupled to the inverter means output for producing a high-frequency output voltage for application to the first and second gas discharge lamps in series;

feedback means having an input for connection in series with at least one of the heatable filaments of the discharge lamps, and having an output connected to control the inverter means; and voltage limiting means for connection to the gas discharge lamps and coupled to the inverter means to limit voltage at the gas discharge lamps.

8. A circuit according to claim 7 wherein the series-resonant LC oscillator means comprises: an inductance for connection in series between the output of the inverter means and the gas discharge lamps; a first capacitance for connection in series with the heatable filaments of the first gas discharge lamp; and a second capacitance for connection in series with the heatable filaments of the second gas discharge lamp.

9. A circuit according to claim 7 wherein the feedback means comprises a transformer having a primary winding for connection in series with at least one of the heatable filaments of the gas discharge lamps, and at least one secondary winding connected to the output of the feedback means.

10. A circuit according to claim 7 wherein the inverter means comprises at least one switching transistor having a base electrode coupled to the output of the feedback means.

11. A circuit according to claim 7 wherein the inverter means comprises first and second switch means and the feedback means comprises: a transformer having a primary winding for connection in series with at least one of the heatable filaments of the gas discharge lamps; a first secondary winding coupled to control the first switch means of the inverter means; and a second secondary winding coupled to control the second switch means of the inverter means.

12. A circuit according to claim 7 wherein the voltage limiting means comprises: a first voltage clamp diode for connection between a point intermediate the series-connected first and second gas discharge lamps and a first input of the inverter means; and a second voltage clamp diode for connection between the point intermediate the series-connected first and second gas discharge lamps and a second input of the inverter means.

13. A circuit for driving first and second gas discharge lamps having heatable filaments, the circuit comprising:

input terminals for connection to a source of voltage supply;

output terminals for connection to the filaments of the gas discharge lamps;

inverter means having first and second switching transistors coupled to the input terminals and having an output;

series-resonant LC oscillator means coupled to the inverter means output for producing a high-frequency output voltage for application to the first and second gas discharge lamps in series, the series-resonant LC oscillator means comprising an inductance for connection in series between the output of the inverter means and the gas discharge lamp load; a first capacitance for connection in series with the heatable filaments of the first gas discharge lamp; and a second capacitance for connection in series with the heatable filaments of the second gas discharge lamp;

a feedback transformer having a primary winding for connection in series with at least one of the heatable filaments of the gas discharge lamp load, and at least one secondary winding connected to control the inverter means; and first and second voltage clamp diodes for connection between a point intermediate the series-connected first and second gas discharge lamps and respectively first and second inputs of the inverter means.

14. A circuit for driving first and second gas discharge lamps having heatable filaments, the circuit comprising:

input terminals for connection to a source of voltage supply;

output terminals for connection to the filaments of the gas discharge lamps;

inverter means coupled to the input terminals and having an output;

first and second series-resonant LC oscillator means coupled to the inverter means output for producing high-frequency output voltages for application respectively to the first and second gas discharge lamps in parallel;

feedback means having an input for connection in series with at least one of the heatable filaments of the discharge lamps, and having an output connected to control the inverter means; and voltage limiting means for connection to the gas discharge lamps and coupled to the inverter means to limit voltage at the gas discharge lamps.

15. A circuit according to claim 14 wherein the first series-resonant LC oscillator means comprises: a first inductance for connection in series between the output of the inverter means and the first gas discharge lamp; and first capacitance means for connection in series with the heatable filaments of the first gas discharge lamp; and wherein the second series-resonant LC oscillator means comprises: a second inductance for connection in series between the output of the inverter means and the second gas discharge lamp; and second capacitance means for connection in series with the heatable filaments of the second gas discharge lamp.

16. A circuit according to claim 14 wherein the feedback means comprises a transformer having a first primary winding for connection in series with the heatable filaments of the first gas discharge lamp, a second primary winding for connection in series with the heatable filaments of the second gas discharge lamp, and at least one secondary winding connected to the output of the feedback means.

17. A circuit according to claim 14 wherein the inverter means comprises at least one switching transistor having a base electrode coupled to the output of the feedback means.

18. A circuit according to claim 14 wherein the inverter means comprises first and second switch means and the feedback means comprises: a transformer having a primary winding for connection in series with at least one of the heatable filaments of the gas discharge lamps; a first secondary winding coupled to control the first switch means of the inverter means; and a second secondary winding coupled to control the second switch means of the inverter means.

19. A circuit according to claim 14 wherein the voltage limiting means comprises: first voltage clamp diode means for coupling between the first gas discharge lamp and a the input of the inverter means; and second voltage clamp diode means for coupling between the first gas discharge lamp and the input of the inverter means.

20. A circuit for driving first and second gas discharge lamps having heatable filaments, the circuit comprising:

input terminals for connection to a source of voltage supply;

output terminals for connection to the filaments of the gas discharge lamps;

inverter means coupled to the input terminals and having first and second switching means and an output;

first and second series-resonant LC oscillator means coupled to the inverter means output for producing high-frequency output voltages for application respectively to the first and second gas discharge lamps in parallel;

transformer feedback means having a first primary winding for connection in series with the heatable filaments of the first gas discharge lamp, a second primary winding for connection in series with the heatable filaments of the second gas discharge lamp, a first secondary winding coupled to control the first switching means of the inverter means, and a second secondary winding coupled to control the second switching means of the inverter means; and first and second voltage limiting means for connection respectively to the first and second gas discharge lamps and coupled to the inverter means to limit voltage at the gas discharge lamps.

* * * * *

UNITED STATES PATENT AND TRADEMARK OFFICE

CERTIFICATE OF CORRECTION

PATENT NO. : 5,220,247

DATED : June 15, 1993

INVENTOR(S) : Mihail S. Moisin

It is certified that error appears in the above-identified patent and that said Letters Patent is hereby corrected as shown below:

At column 9, line 56, insert after "voltage" --supply;--.

Signed and Sealed this

First Day of February, 1994

Bruce Lehman

*Attest:*

BRUCE LEHMAN

*Attesting Officer*

*Commissioner of Patents and Trademarks*